US005279324A

United States Patent [19]

Schütz et al.

[11] Patent Number: 5,279,324

[45] Date of Patent: Jan. 18, 1994

[54] ANTI-SIPHONING VALVE ASSEMBLY AND PLUMBING FIXTURE INCLUDING SAME

[75] Inventors: Willi Schütz, Buchs; Ferdinand Hochstrasser, Auenstein, both of Switzerland

[73] Assignee: KWC AG, Unterkulm, Switzerland

[21] Appl. No.: 979,770

[22] Filed: Nov. 20, 1992

[51] Int. Cl.[5] ..... E03C 1/10

[52] U.S. Cl. ..... 137/218; 137/801

[58] Field of Search ..... 137/218, 801, 217

[56] References Cited

U.S. PATENT DOCUMENTS

| | | | |
|---|---|---|---|
| Re. 26,235 | 7/1967 | Woodford . | |
| D. 297,257 | 8/1988 | Kohler, Jr. et al. . | |
| 926,968 | 7/1909 | Stickdorn . | |
| 1,755,993 | 4/1930 | Kelley et al. | 137/218 |
| 2,211,212 | 9/1939 | Langdon . | |
| 2,219,259 | 10/1940 | Horn | 137/217 |
| 2,259,984 | 1/1940 | Anderson . | |
| 2,322,631 | 6/1940 | Groeniger . | |
| 2,756,763 | 7/1956 | Morgenstern . | |
| 2,850,034 | 9/1958 | Svabek, Jr. et al. . | |
| 3,104,674 | 9/1963 | Bills et al. . | |
| 3,145,724 | 8/1964 | Pelzer . | |
| 3,414,003 | 12/1968 | Wyckoff . | |
| 3,424,189 | 1/1969 | Woodford . | |
| 3,633,613 | 1/1972 | Julow . | |
| 3,929,149 | 12/1975 | Phillips . | |
| 4,084,606 | 4/1978 | Mittleman . | |
| 4,301,972 | 11/1981 | Rudelick . | |
| 4,314,673 | 2/1982 | Rudelick . | |
| 4,478,236 | 10/1984 | Neuzeret et al. . | |
| 4,489,746 | 12/1984 | Daghe et al. . | |
| 4,508,136 | 4/1985 | Kah, Jr. . | |
| 4,508,137 | 4/1985 | Bolgert . | |
| 4,553,563 | 11/1985 | Daghe et al. . | |
| 4,630,643 | 12/1986 | Lorch . | |
| 4,696,322 | 9/1987 | Knapp et al. . | |
| 4,805,661 | 2/1989 | Knapp et al. . | |
| 4,821,762 | 4/1989 | Breneman . | |
| 4,827,538 | 5/1989 | Heimann et al. . | |
| 4,969,483 | 11/1990 | Knapp . | |
| 5,038,814 | 8/1991 | Gayton et al. . | |
| 5,079,781 | 1/1992 | Gnauert et al. . | |
| 5,095,554 | 3/1992 | Gloor . | |
| 5,103,856 | 4/1992 | Fleischmann . | |
| 5,123,437 | 6/1992 | Egli et al. . | |
| 5,213,268 | 5/1993 | Gnauert et al. . | |

FOREIGN PATENT DOCUMENTS

| | | | |
|---|---|---|---|
| 1144209 | 2/1963 | Fed. Rep. of Germany | 137/218 |

OTHER PUBLICATIONS

ANSI A112 Committee, Panel 18, "Faucets with Hose Connected Outlets Back Pressure Backflow and Back Siphonage", Friedrich Grohe, San Francisco, Mar. 9, 1988.

ANSI/ASME A112.18.1M-198X, Plumbing Fixture Fittings, "Performance Requirements and Test Procedures for Fixture Fittings with Hose Connected Outlets", The American Society of Mechanical Engineers, Nov. 22, 1988.

*Primary Examiner*—Gerald A. Michalsky

*Attorney, Agent, or Firm*—Oliff & Berridge

[57] ABSTRACT

A plumbing system is provided with a coupling having a chamber, an inlet passageway through which a fluid may enter the chamber from a supply, an outlet passageway through which a fluid may exit the chamber and the coupling, and a vent passageway in fluid communication with the chamber and having a vent inlet in communication with ambient atmosphere and a vent outlet in communication with the chamber. The coupling is provided between a source of liquid (e.g. a control capsule for mixing hot and cold water supplies via a user operable valve) and an outlet nozzle (e.g., a hose-connected spray head). A vacuum breaker check valve is located in the vent passageway of the coupling and includes a valve member for closing the vent inlet when pressure in the chamber is greater than pressure at the vent inlet and for opening the vent inlet when pressure in the chamber is less than pressure at the vent inlet.

25 Claims, 3 Drawing Sheets

ANTI-SIPHONING VALVE ASSEMBLY AND PLUMBING FIXTURE INCLUDING SAME

BACKGROUND OF THE INVENTION

1. Field of the Invention

The present invention relates to devices for preventing the back flow of water in plumbing systems, and in particular, to vacuum breaker type anti-siphoning mechanisms.

2. Description of Related Art

Plumbing fixtures have been provided which include a hose-connected spray head which can be manipulated by a user to provide a stream of water, for example, to wash hair or to rinse dishes, for example, in a sink.

One problem inherent with such movable spray heads is that the water supply lines can become contaminated if the spray head is immersed in contaminated water (e.g., as is found in a water-filled sink). Should a negative pressure occur in the water supply (e.g., due to a water main break or the use of water at other outlets in the plumbing system) a back flow or siphoning of water from the sink through the spray head and into the plumbing system may occur. This back flow of water contaminates the water supply.

While one or more one-way back pressure check valves are conventionally provided in the plumbing system to prevent the undesirable back flow of water, these check valves do not always prevent the back flow of water due to, for example, the lodging of sediment in the check valves preventing them from closing properly. Accordingly, it is known to provide vacuum breakers in plumbing systems so that when a vacuum condition occurs in the water supply, air is introduced into the plumbing system through the vacuum breaker, preventing waste water from being pulled into the water supply.

U.S. Pat. No. 5,103,856 to Fleischmann discloses an anti-siphoning valve assembly for placement between the outlet tube of a faucet and a spray head. The assembly includes a T-shaped housing having duck-bill check valves in its inlet and outlet passages in order to restrict fluid flow to only one direction through the housing, and a vacuum breaker attached to a sink rim and in fluid communication with a chamber of the T-shaped housing via a flexible conduit. A float is located in the vacuum breaker housing to prevent liquid from exiting the vacuum breaker housing during normal flow conditions and for permitting the plumbing system to be vented when a vacuum condition occurs in the water supply. A problem with this arrangement is that the flexible conduit attached between the T-shaped housing and the vacuum breaker housing forms a dead-end in which water becomes trapped for extended periods of time. Such water can become contaminated (e.g., by bacteria and microbes). The water in the flexible conduit is pulled into the water supply when a vacuum condition occurs in the water supply, thus potentially causing contamination of the water supply. Additionally, the contaminated water in the flexible conduit gradually makes its way into the water supplied to the spray head, which can be undesirable.

U.S. Pat. No. 5,038,814 to Gayton et al. discloses a back flow preventer and vacuum breaker for use with a plumbing fixture, and includes a body having an inlet and an outlet, a chamber connecting the inlet and outlet and an air vent opening into the chamber. A first diaphragm is positioned within the chamber and controls air flow through the vent. A second diaphragm positioned in the chamber controls flow from the inlet into the chamber and includes an integral check valve extending into the outlet.

Page 12 of the Nov. 22, 1988 Minutes of the ANSI/ASME A 112 Committee, Panel 18 schematically illustrates numerous arrangements for locating back flow preventers and vacuum breakers in a plumbing system having hose connected outlets.

Other patents disclosing back flow preventers, with or without vacuum breakers, for hose-connected spray heads include: U.S. Pat. Nos. 4,805,661 and 4,696,322 to Knapp et al.; U.S. Pat. No. 5,079,781 to Gnauert et al.; U.S. Pat. No. 5,095,554 to Gloor; U.S. Pat. No. 4,827,538 to Heimann et al.; U.S. Pat. No. 4,969,483 to Knapp; U.S. Pat. Nos. 4,301,972 and 4,314,673 to Rudelick; U.S. Pat. No. 5,123,437 to Egli et al.; and U.S. Pat. No. 4,508,136 to Kah, Jr.

Additional references disclosing floats used as vacuum breaker check valves include U.S. Pat. No. 3,414,003 to Wyckoff, U.S. Pat. No. 4,821,762 to Breneman, U.S. Pat. No. 926,968 to Stickdorn and a paper presented by Friedrich Grohe at the Mar. 9, 1988 ANSI/AMSE A 112 Committee, Panel 18 meeting, for use with faucets having hose connected outlets.

A back flow preventer device for connection between a supply pipe and a service pipe, and including one-way check valves at an inlet and outlet of a body member, and a spring biased vacuum breaker located in a separate housing attached to the body member by a tube is disclosed in U.S. Pat. No. 4,489,746.

U.S. Pat. No. 3,929,149 to Phillips discloses a back flow preventer for installation in the water discharge line between an automatic dishwasher and a garbage disposer which can be mounted to a sink rim.

SUMMARY OF THE INVENTION

In order to achieve the above and other objects, and to overcome the shortcomings set forth above, a plumbing system is provided with a coupling having a chamber, an inlet passageway through which a fluid may enter the chamber from a supply, an outlet passageway through which a fluid may exit the chamber and the coupling, and a vent passageway in fluid communication with the chamber and having a vent inlet in communication with ambient atmosphere and a vent outlet in communication with the chamber. The coupling is provided between a source of liquid (e.g. a control capsule for mixing hot and cold water supplies via a user operable valve) and an outlet nozzle (e.g., a hose-connected spray head). A back pressure check valve is in fluid communication with the inlet passageway (e.g., by being located in the inlet passageway) for restricting fluid flow through the inlet passageway to only a direction into the chamber. A vacuum breaker check valve is located in the vent passageway of the coupling and includes a valve member for closing the vent inlet when pressure in the chamber is greater than pressure at the vent inlet and for opening the vent inlet when pressure in the chamber is less than pressure at the vent inlet. During normal operation, when liquid is supplied to the outlet nozzle, liquid pressure in the chamber causes the vacuum breaker valve member to close the vent inlet so that water is supplied to the nozzle outlet. However, when a vacuum occurs in the water supply, the pressure within the chamber in the coupling drops, causing the vacuum breaker valve member to open the vent inlet, venting the water supply to atmosphere and preventing liquid downstream of the coupling from being pulled into the water supply.

In a preferred embodiment, the vent inlet is connected to a ventilation outlet of a ventilation housing by a vent conduit. The ventilation housing includes a ventilation inlet connected to the ventilation outlet via a ventilation passageway and means for mounting the ventilation housing to a member separate from the coupling (e.g., an aperture in a sink rim) . Accordingly, if the vacuum breaker valve member in the coupling fails to fully block the flow of water through the vent inlet during normal operation, liquid will flow through the vent inlet, the vent conduit and the ventilation housing and into the sink. This prevents water damage from occurring should the vacuum breaker valve member fail to function properly, and also permits such a defect to be immediately recognized.

A second vacuum breaker check valve can be located in the ventilation passageway connecting the ventilation inlet and outlet, and acts as a backup to the vacuum breaker check valve located in the coupling. The second vacuum breaker check valve closes the ventilation inlet when pressure in the ventilation passageway is substantially greater than pressure at the ventilation inlet, and opens the ventilation inlet when pressure in the ventilation passageway is not greater than pressure at the ventilation inlet.

Preferably, both the first and second vacuum breaker check valves are float valves biased only by gravity so that the response time to a vacuum condition in a water supply is short.

The back pressure check valve located in the inlet passageway of the coupling is preferably a duck-bill check valve. Additionally, a second back pressure check valve can be provided in fluid communication with the outlet passageway (e.g., in the spray head) for restricting fluid flow through the outlet passageway to only a direction from the chamber. The second back pressure check valve can also be a duck-bill check valve or other well known check valves which require more space than the duck-bill check valve.

The coupling is preferably a one-piece, T-shaped member, and when the (duck-bill) back pressure check valve and the vacuum breaker check valve are located respectively in the inlet passageway and the vent passageway, a compact system is provided which is easy to handle and install.

The disclosed system also eliminates the amount of water trapped in "dead ends" of the system, where such water can become contaminated (e.g., by bacteria and microbes).

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
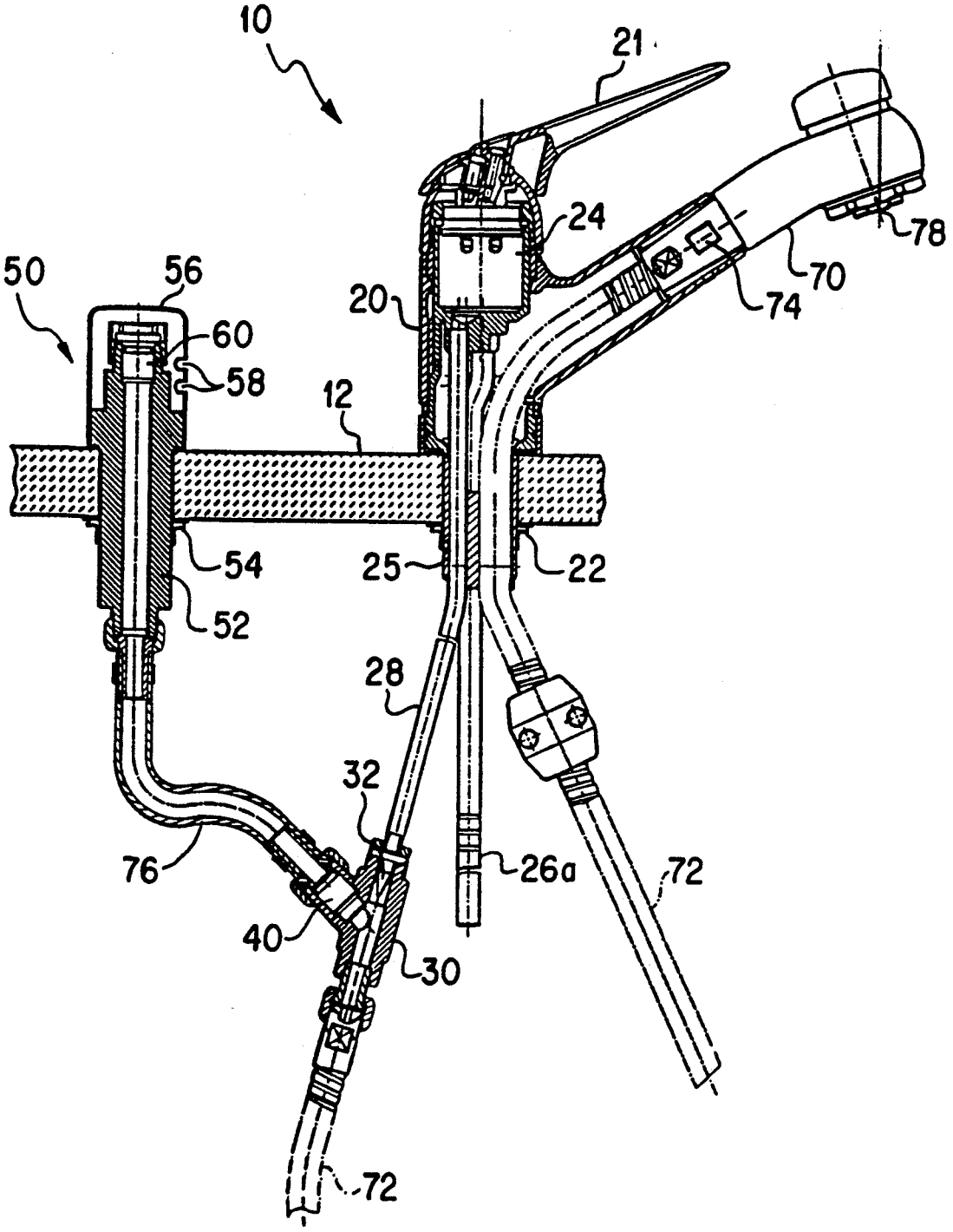
FIG. 1 is a sectional view of a plumbing fixture including a faucet incorporating and anti-siphoning device in accordance with the present invention.

With reference to FIG. 1, a plumbing fixture 10 includes a faucet 20 and a ventilation unit 50 which can be mounted through respective apertures in, for example, a sink rim 12. Faucet 20 includes a tube 25 which can be inserted through a first aperture in sink rim 12 and mounted to sink, rim 12 with a nut 22. Faucet 20 includes, for example, a conventional control capsule 24 which functions as a mixing chamber for mixing hot and cold water provided through supply lines (only one supply line, 26*a*, is illustrated), and is controlled by a user operable control lever 21. The controllably mixed water exits capsule 24 through outlet pipe 28. A pull-out hose spray head 70 having outlet nozzle 78 is removably secured to faucet 20, and includes a hose 72 attaching spray head 70 to outlet pipe 28 by coupling 30.

Figure 2:
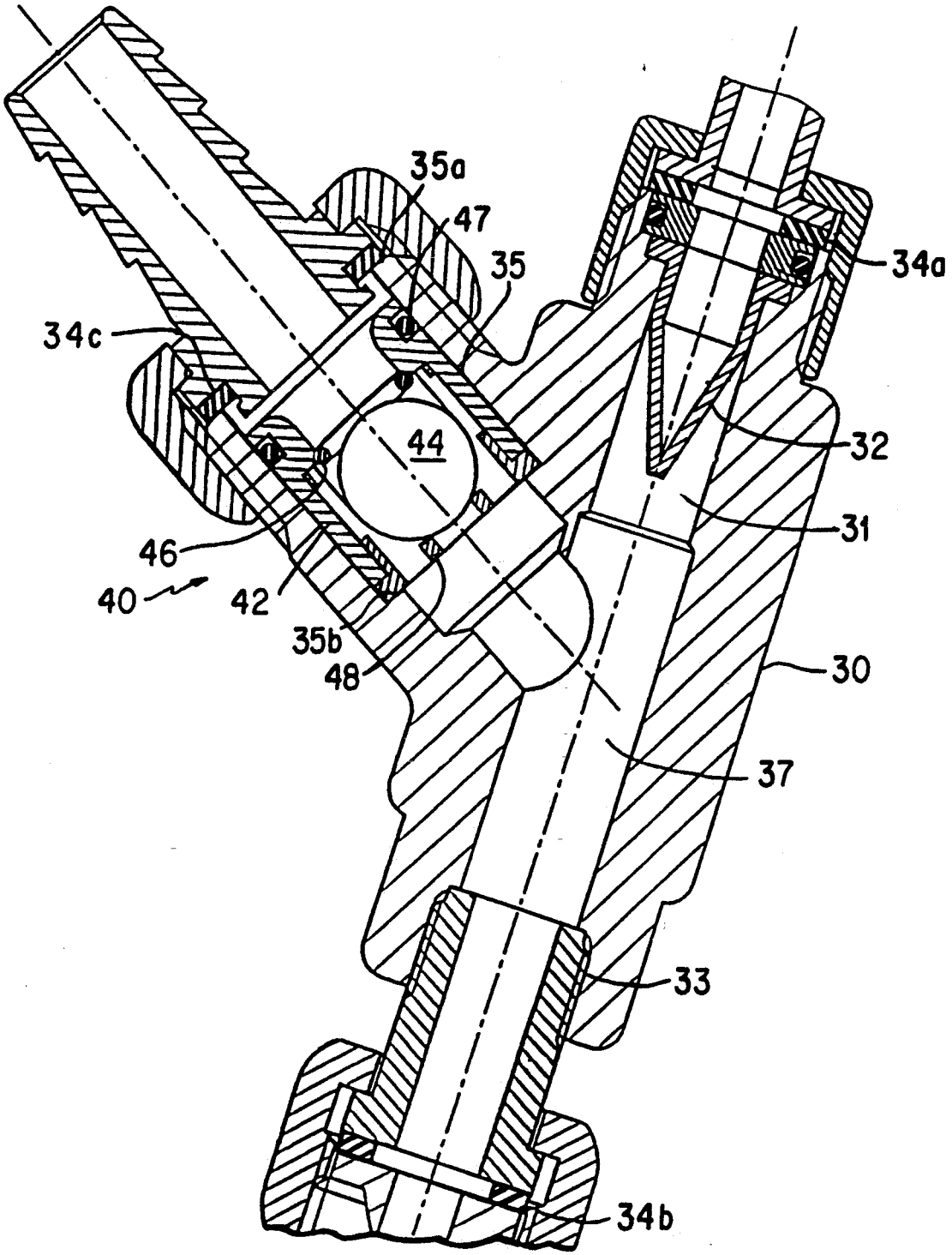
FIG. 2 is a cross-sectional view of a T-shaped coupling used in the present invention in a state when fluid is not flowing through the plumbing system.

Coupling 30 is T-shaped, preferably one-piece, and, with reference to FIG. 2, includes an inlet passageway 31, an outlet passageway 33, a chamber 37 in fluid communication with inlet passageway 31 and outlet passageway 33, and a vent passageway 35 in fluid communication with chamber 37. Inlet passageway 31 is connected to outlet pipe 28 and preferably includes a back pressure check valve 32 therein for restricting fluid flow through inlet passageway 31 to only a direction into chamber 37. Preferably, back pressure check valve 32 is a duck-bill check valve. Outlet passageway 33 is connected to hose 72. A second back pressure check valve can be located in outlet passageway 33. However, if a second back pressure check valve is provided, it is preferably located in spray head 70 as illustrated by reference numeral 74. Locating second back pressure check valve 74 in spray head 70 prevents water from draining out of spray head 70 and hose 72 after water flow is shut off (i.e., via user manipulation of control lever 21), and can be, for example, a duck-bill check valve or any other suitable conventional check valve.

A vacuum breaker check valve 40 is located in vent passageway 35 between a vent inlet 35*a* and a vent outlet 35*b*. Vacuum breaker check valve 40 includes a sleeve 42 mounted in vent passageway 35. A ball-type valve member 44 is located in sleeve 42 and is free to move between an O-ring 46 and a stop member 48. Vent inlet 35*a* is in communication with ambient atmosphere, and when the pressure in chamber 37 is at or below ambient atmosphere, ball 44 rests on stop 48 and permits air to flow from vent inlet 35*a* into chamber 37 (i.e., to break a vacuum condition existing in the water supply). When the pressure in chamber 37 is greater than ambient, the liquid in chamber 37 causes ball 44 to seat with O-ring 46, preventing flow through vent inlet 35*a*. Thus, ball 44 rises in the water until sealing against O-ring 46. Sleeve 42 is sealed within vent passageway 35 by a gasket 47. Additionally, conventional gaskets 34*a*, 34*b* and 34*c* are provided where coupling 30 is connected to outlet pipe 28, hose 72 and a vent hose 76, respectively.

Figure 4:
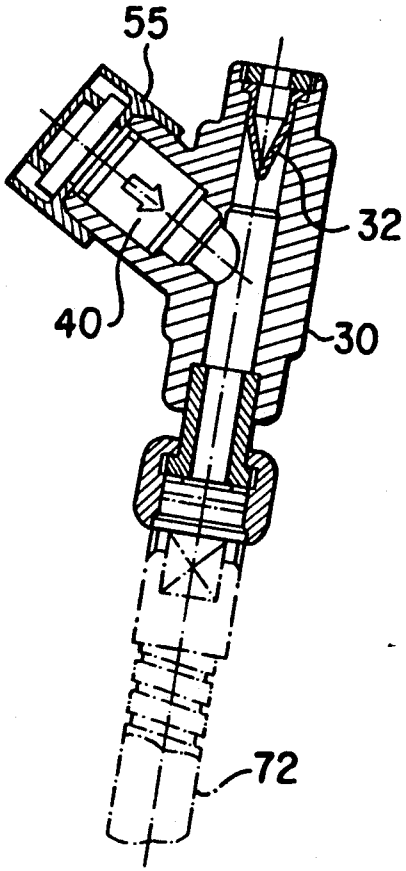
FIG. 4 is a cross-sectional view of the T-shaped coupling for use without the ventilation housing of FIG. 3.

Although the plumbing fixture 10 can be provided with the coupling 30 shown in FIG. 2 or FIG. 4, without ventilation unit 50 and vent hose 76, should vacuum breaker valve 40 become jammed or be defective, water will flow from chamber 37 through vent inlet 35*a* potentially causing water damage to surrounding surfaces. Accordingly, it is preferred to provide some means for collecting water emitted through vent inlet 35*a* should vacuum breaker check valve 40 become defective.

Figure 3:
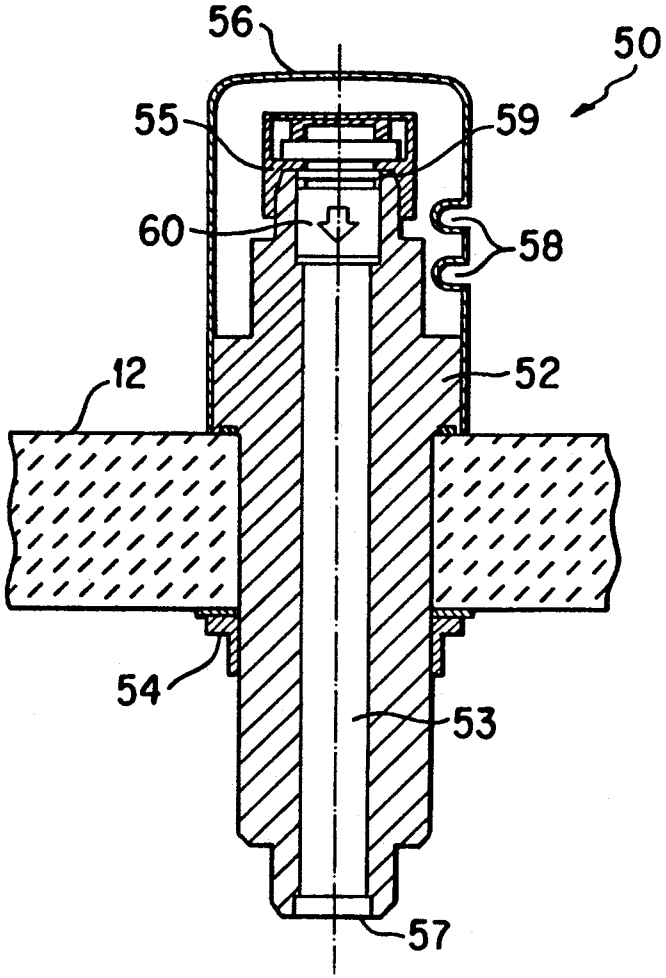
FIG. 3 is a cross-sectional view of a ventilation housing mounted to a sink rim in accordance with a preferred embodiment of the present invention.

One preferred way of directing liquid from vent inlet 35a to a drain is to connect vent inlet 35a to ventilation unit 50 via vent hose 76. As shown in FIG. 3, ventilation unit 50 includes a ventilation housing 52 which can be mounted through a second aperture in, for example, sink rim 12 via a second nut 54. A ventilation passageway 53 is provided through ventilation housing 52 and connects a ventilation inlet 59 with a ventilation outlet 57. Ventilation outlet 57 is in fluid communication with vent hose 76. A cap 56 having vent slots 58 is provided over the upper end of ventilation housing 52. Accordingly, if vacuum breaker check valve 40 becomes jammed or defective, water flows through vent hose 76, ventilation outlet 57, ventilation passageway 53 and ventilation inlet 59 to be directed to the sink drain without causing water damage to surrounding surfaces.

The flow of liquid through ventilation housing 52 provides an indication to the user that vacuum breaker check valve 40 requires servicing.

To provide a backup to vacuum breaker check valve 40, a second vacuum breaker check valve 60 having a structure similar to first vacuum breaker check valve 40 can be provided in ventilation passageway 53 as indicated in FIG. 3. As illustrated by the arrow on second vacuum breaker check valve 60, flow is permitted through ventilation inlet 59 in a direction similar to the flow direction permitted by first vacuum breaker check valve 40. Second vacuum breaker check valve 60 includes a second valve member (e.g., a ball float) for closing ventilation inlet 59 when pressure in ventilation passageway 53 is substantially greater than pressure at ventilation inlet 59 (i.e. when liquid is being supplied to spray head 70 and first vacuum breaker check valve 40 is defective causing the water to flow through vent tube 76 and ventilation passageway 53). The second valve member in second vacuum breaker check valve 60 opens the ventilation inlet when pressure in ventilation passageway 53 is not greater than pressure at ventilation inlet 59 (i.e., all of the time when first vacuum breaker 40 is functioning properly, or when first vacuum breaker check valve 40 is defective and a vacuum condition exists in the water supply). A plug member 55 is provided over ventilation inlet 59 to maintain second vacuum breaker check valve 60 in place. Plug member 55 includes one or more apertures therein to permit fluid to flow between ventilation inlet 59 and ambient atmosphere.

When the anti-siphoning system is being used without ventilation unit 50 and vent tube 76, plug member 55 can be located over vent inlet 35a as illustrated in FIG. 4 in order to hold vacuum breaker check valve 40 in place.

Since first vacuum breaker check valve 40 located in coupling 30 prevents the flow of liquid into vent hose (flexible conduit) 76, water is not usually present in vent hose 76 or ventilation unit 50. This is advantageous because water which flows past check valve 40 and into vent hose 76 is located in a dead-end and may remain there for unsatisfactorily long periods of time. For example, tests conducted on a system having only second vacuum breaker check valve 60 (i.e., no vacuum breaker check valve 40 was provided in vent passageway 35 of coupling 30) have shown that water becomes trapped in hose 76 and that it is necessary to turn on the water flow (i.e., with control lever 21) about 150 times in order to exchange the water trapped in vent hose 76. Such water remains in vent hose 76 for a long time without being replaced and can lead to the formation of bacteria and microbes therein. These microbes are then undesirably introduced into the water supply when a vacuum condition exists in the water supply. Additionally, sediments and minerals can become deposited in hose 76 and ventilation passageway 53 leading to clogging of these members due to the prolonged presence of water in hose 76 and unit 50.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An anti-siphoning apparatus for a plumbing system comprising:

a coupling having a chamber, an inlet passageway through which a fluid may enter the chamber from a supply, an outlet passageway through which a fluid may exit the chamber and the coupling, and a vent passageway in fluid communication with the chamber and having a vent inlet in communication with ambient atmosphere and a vent outlet in fluid communication with said chamber;

a back pressure check valve in fluid communication with said inlet passageway for restricting fluid flow through the inlet passageway to only a direction into the chamber;

a vacuum breaker check valve located in said vent passageway in said coupling and including a valve member for closing said vent inlet when pressure in the chamber is greater than pressure at the vent inlet and for opening the vent inlet when pressure in the chamber is less than pressure at the vent inlet;

a ventilation housing having a ventilation inlet, a ventilation outlet, and means for mounting said ventilation housing through an aperture in a sink rim; and a vent hose connecting said vent inlet with said ventilation outlet, wherein said valve member is substantially closer to said chamber than to said ventilation inlet.

2. The apparatus of claim 1, wherein said vacuum breaker valve member is biased only by gravity.

3. The apparatus of claim 1, further comprising a second vacuum breaker check valve located in a ventilation passageway connecting said ventilation inlet to said ventilation outlet within said ventilation housing, and including a second valve member for closing said ventilation inlet when pressure in the ventilation passageway is substantially greater than pressure at the ventilation inlet and for opening the ventilation inlet when pressure in the ventilation passageway is not greater than pressure at the ventilation inlet.

4. The apparatus of claim 3, wherein said first and second vacuum breaker check valves are biased only by gravity.

5. The apparatus of claim 1, wherein said back pressure check valve is located in said inlet passageway.

6. The apparatus of claim 5, wherein said back pressure check valve is a duck-bill check valve.

7. The apparatus of claim 1, further comprising a second back pressure check valve in fluid communication with said outlet passageway for restricting fluid flow through the outlet passageway to only a direction from the chamber.

8. The apparatus of claim 7, further comprising an outlet spout attached to a first end of an outlet hose, a second end of said outlet hose attached to said outlet passageway, and wherein said second back pressure check valve is located in said outlet spout.

9. A plumbing fixture comprising:

a faucet having a user operable valve for controlling fluid flow from a supply line to an outlet tube, and having a spout through which fluid can flow to produce an output stream;

a coupling separated from said faucet and forming a chamber and having an inlet coupling the outlet tube to the chamber, an outlet coupling the spout to the chamber, said chamber extending linearly between said inlet and said outlet, and a vent passageway branching off rom said chamber and in fluid communication with the chamber and having a vent inlet in communication with ambient atmosphere and a vent outlet in fluid communication with and attached to said chamber;

a back pressure check valve in fluid communication with said inlet passageway for restricting fluid flow through the inlet passageway to only a direction form the outlet tube into the chamber; and a vacuum breaker check valve located in said vent passageway in said coupling and including a valve member in close proximity to said vent passageway outlet and said chamber for closing said vent inlet when pressure in the chamber is greater than pressure at the vent inlet and for opening the vent inlet when pressure in the chamber is not greater than pressure at the vent inlet, and means for mounting said valve member in said vent passageway for minimizing the volume of liquid trapped between said chamber and said valve member.

10. The fixture of claim 9, wherein said spout is a spray head having a flexible hose attached to said coupling outlet passageway.

11. The fixture of claim 9, wherein said vacuum breaker check valve is biased only by gravity.

12. The fixture of claim 9, further comprising:

a ventilation housing having a ventilation inlet, a ventilation outlet, and means for mounting said ventilation housing to a member separate from said coupling; and a vent conduit connecting said vent inlet with said ventilation outlet.

13. The fixture of claim 12, wherein said means for mounting said ventilation housing to a member separate from said coupling is capable of mounting said ventilation housing through an aperture in a sink rim.

14. The fixture of claim 9, wherein said back pressure check valve is located in said inlet.

15. The fixture of claim 9, further comprising a second back pressure check valve in fluid communication with said outlet for restricting fluid flow through the outlet to only a direction from the chamber to said spout.

16. The fixture of claim 15, wherein said second back pressure check valve is located in said spout.

17. The fixture of claim 9, wherein said coupling is one-piece.

18. A plumbing fixture comprising:

a faucet having a user operable valve for controlling fluid flow from a supply line to an outlet tube, and having a spout through which fluid can flow to produce an output stream;

a coupling forming a chamber and having an inlet passageway coupling the outlet tube to the chamber, an outlet passageway coupling the spout to the chamber, and a vent passageway in fluid communication with the chamber and having a vent inlet and a vent outlet in fluid communication with said chamber;

a back pressure check valve in fluid communication with said inlet passageway for restricting fluid flow through the inlet passageway to only a direction from the outlet tube into the chamber;

a first vacuum breaker check valve located in said vent passageway in said coupling and including a valve member for closing said vent inlet when pressure in the chamber is greater than pressure at the vent inlet and for opening the vent inlet when pressure in the chamber is not greater than pressure at the vent inlet;

a ventilation housing having a ventilation inlet, a ventilation outlet, means for mounting said ventilation housing to a member separate from said coupling, and a second vacuum breaker check valve located in a ventilation passageway connecting said ventilation inlet to said ventilation outlet within said ventilation housing, said second vacuum breaker check valve including a second valve member for closing said ventilation inlet when pressure in the ventilation passageway is substantially greater than pressure at the ventilation inlet and for opening the ventilation inlet when pressure in the ventilation passageway is not greater than pressure at the ventilation inlet; and a vent hose connecting said vent inlet with said ventilation outlet, said first valve member and said second valve member located adjacent to opposite ends of said vent hose.

19. The fixture of claim 18, wherein said first and second vacuum breaker check valves are biased only by gravity.

20. The fixture of claim 18, wherein said spout is a spray head having a flexible hose attached to said coupling outlet passageway.

21. The fixture of claim 18, wherein said means for mounting said ventilation housing to a member separate from said coupling is capable of mounting said ventilation housing through an aperture in a sink rim.

22. The fixture of claim 18, wherein said back pressure check valve is located in said inlet passageway.

23. The fixture of claim 18, further comprising a second back pressure check valve in fluid communication with said outlet passageway for restricting fluid flow through the outlet passageway to only a direction from the chamber to said spout.

24. The fixture of claim 23, wherein said second back pressure check valve is located in said spout.

25. The fixture of claim 18, wherein said coupling is one-piece.

* * * * *